US007796766B2

(12) United States Patent
Rishøj

(10) Patent No.: US 7,796,766 B2
(45) Date of Patent: Sep. 14, 2010

(54) AUDIO CENTER CHANNEL PHANTOMIZER

(75) Inventor: Kim Rishøj, Egå (DK)

(73) Assignee: The TC Group A/S (DK)

( * ) Notice: Subject to any disclaimer, the term of this patent is extended or adjusted under 35 U.S.C. 154(b) by 1703 days.

(21) Appl. No.: 10/203,831

(22) Filed: Nov. 18, 2002

(65) Prior Publication Data

US 2003/0142830 A1 Jul. 31, 2003

(30) Foreign Application Priority Data

Feb. 11, 2000 (DK) ..... 2000 00223

(51) Int. Cl.
*H04R 5/00* (2006.01)

(52) U.S. Cl. ..... 381/27; 381/300; 381/310

(58) Field of Classification Search ..... 381/27, 381/18, 339, 1, 309, 310, 17, 19, 61, 62, 381/63, 300
See application file for complete search history.

(56) References Cited

U.S. PATENT DOCUMENTS 4,136,260 A 1/1979 Asahi
5,189,703 A * 2/1993 Holman ..... 381/61
5,251,260 A * 10/1993 Gates ..... 381/18
5,333,200 A * 7/1994 Cooper et al. ..... 381/1
5,594,800 A 1/1997 Gerzon
5,657,391 A * 8/1997 Jyosako ..... 381/1
5,844,993 A * 12/1998 Ilda et al. ..... 381/18
7,003,119 B1 * 2/2006 Arthur ..... 381/17

FOREIGN PATENT DOCUMENTS

| | | |
|---|---|---|
| DE | 3233990 | 3/1984 |
| EP | 0 880 301 | 11/1998 |
| EP | 0 966 179 | 12/1999 |
| WO | WO 97/37512 | 10/1997 |

* cited by examiner

*Primary Examiner*—Vivian Chin
*Assistant Examiner*—Con P Tran
(74) *Attorney, Agent, or Firm*—Cantor Colburn LLP

(57) ABSTRACT

The invention relates to a method of processing an input signal into a phantomized signal, including adding at least one attenuated delayed signal to the input signal, the phantomized signal having at least one delayed attenuated signal and the input signal. A phantomized signal according to the invention offers a new and impressive integration of a center channel signal of a multi channel audio system into the complete audio image provided by the system.

12 Claims, 4 Drawing Sheets

AUDIO CENTER CHANNEL PHANTOMIZER

FIELD OF THE INVENTION

Figure 1:
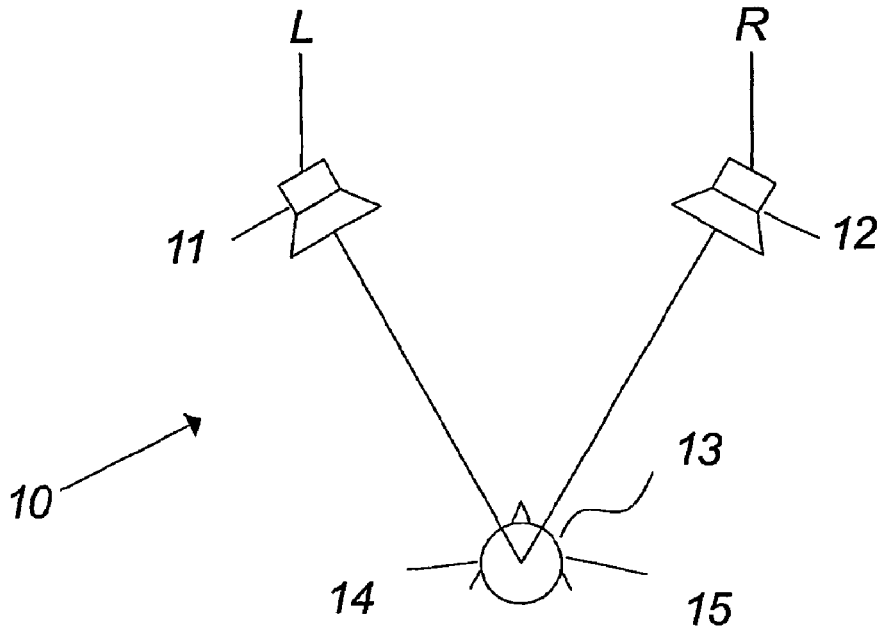
Fig.1 (PRIOR ART)

The invention relates to a method of processing an input signal into a phantomized signal, a phantomizer for processing a signal into a phantomized signal, and an inverse phantomizer according to claim 8.

BACKGROUND OF THE INVENTION

For the past several decades, high quality loudspeakers for studio monitoring as well as domestic use have been designed and optimized for use in a traditional two-channel stereophonic setup. When optimizing the timbre of such loudspeakers, the primary objective is to improve the perceived reproduction quality of voices and musical instruments at the center of the stereo image, right between the loudspeakers, where the solo singer or instrument is usually located. This perceived location improvement is obtained simply by feeding the source signal to both stereo loudspeakers simultaneously at an identical level and phase. We will call this reproduction channel the phantom center channel.

When switching from stereophonic to multi-channel audio, the phantom center channel is usually replaced by a physical center channel: A loudspeaker located straight in front of the listener. This was originally maintained when extending cinema systems from monophonic to stereophonic format for the purpose of ensuring correct localization of the movie dialog for all seats in the theatre. Via home cinema systems, such a loudspeaker arrangement has now been standardized for multi-channel audio as well (according to ITU-R Recommendation BS.775-1, "Multi-channel Stereophonic Sound Systems with and without Accompanying Picture", International Telecommunication Union, Geneva, Switzerland, 1992-1994). Also, the use of a physical center channel in audio-only systems will make the stereo image less sensitive to variations in the listener's position.

However, as the music industry gained experience with this new reproduction format, one problem became apparent: many highly esteemed music producers decided not to use the physical center channel at all, thus discarding its beneficial stabilizing effect on the stereo image.

It is the object of this invention to provide a solution which will make the use of the physical center channel attractive.

SUMMARY OF THE INVENTION

The invention relates to a method of processing a center input signal into a phantomized signal comprising the step of adding at least one attenuated delayed signal to the said input signal, phantomized signal comprising at least one delayed attenuated signal and said input signal.

A phantomized signal according to the invention offers a new and impressive illusion of a non-panned signal (center image) of a traditional stereo-system while maintaining a true reproduction of a non-panned signal into only one channel.

The obtained phantomized signal may e.g. be fed directly to the sound reproduction system or distribution medium or manipulated by further signal processing means such as reverberation or delay units.

Preferably, the complete signal contents of the original input signal and the delayed and attenuated signal should be fed to only one center channel of a multi-channel signal system. Evidently, insignificant signal components of the input signal or the phantomized signal may be fed to the other channels of the rendering system within the scope of the invention.

Evidently, both the original input signal and the added delayed signal may be colored by means of additional filtering means.

According to the invention, the term "phantomized signal" refers to a signal located in the center image of a traditional multi-channel reproduction system having no center channel. Such a signal may typically refer to a traditional two-channel stereo reproduction system and may typically be located in the center sound image by means of simple panning.

A phantomized center channel signal is a signal which has been manipulated in such a way that the timbre of the signal, when reproduced in the center channel, may be perceived by a listener to be a phantomized signal which has been established in the above-mentioned traditional multi-channel system having no center channel.

It should be noted, that further coloring and more or less manipulated delay signals may be added to the input signal within the scope of the invention.

It should moreover be emphasized that the terms phantomizing/phantomizer/phantomized basically refers to an integration of a center channel signal of a multi channel rendering system into the complete sound image, thereby avoiding that the center channel dominates the sound image.

According to the invention, the method of processing, i.e. phantomizing the center channel, may be performed during the mixing of the multi channel audio signal, or the phantomizing may be performed as on-off operation in the rendering system in line with e.g. the traditional Dolby compressing and de-compressing systems.

Hence, the multichannel audio signal may comprise a distinct center channel, which may subsequently be broadened if the user of the rendering system actually prefers the phantomizing of the center channel.

A further way of implementing the processing according to the invention is that an engineer, when mixing the audio signal, phantomizes the center-channel according to the invention, thereby facilitating a rendering of a phantomized center channel.

The rendering system may then, if so desired, comprise a de-phantomizer (inverse phantomizer), which may be activated if the user of the rendering system prefers a distinct rendering of the center channel.

The invention facilitates a motivation to the sound engineers to utilize the center channel in multi-channels sound reproducing system having a center channel.

Moreover, it should be noted that the term delay basically refers to a mutual relationship between the direct signal and the delayed part of the direct signal.

Moreover, it should be noted that the delay may be established in numerous ways within the scope of the invention as long as the delayed signal (which may evidently comprise further delayed signals and processed signal components) represents an approximation to HRTF based transfer functions between the listener(s) and the available loudspeakers.

A phantomized signal according to the invention offers a new and impressive integration of a center channel signal of a multi channel audio system into the complete audio image provided by the system.

In one embodiment the phantomized signal is fed to the center channel of a multi-channel audio reproduction system or medium.

When adding an attenuated delayed center channel signal to the center channel signal, a phantomized center channel signal has been obtained by means of simple signal processing without the requirement of redesign of the loudspeaker used for center channel reproduction.

According to the invention, an advantageous processing method of center channel sound signal has been obtained.

According to the invention, a center channel signal may be manipulated by means of simple signal processing into a center channel signal having artificial panning corresponding to panning of traditional sound reproduction systems like stereo. It should be noted that the desired two-channel effect has been obtained by manipulation and reproduction of only one channel.

Hence, a sound engineer may now use the center channel in a music production. It should nevertheless be noted that a method according to the invention may be applied to both speech and music signals.

The method comprises comb-filtering of the input signal.

Comb-filtering of the center-channel represents a very simple and cost effective implementation, and the filter may be applied by a sound engineer by means of a simple optional on-/off switch.

Evidently, the comb-filtering may be applied to the center channel by means of e.g. an equalizer being carefully adjusted to fit to the desired comb-filtering characteristics.

The at least one delayed attenuated signal is delayed 0.2 ms to 0.4 ms with respect to the signal added to the said at least one delayed attenuated signal, preferably 0.3 ms+/−0.05 ms.

The at least one delayed attenuated signal is attenuated 5 dB to 20 dB with respect to the signal added to the said at least one delayed attenuated signal, preferably 9 to 12 dB.

The phantomized signal (58; PMCCS) comprises said at least one delayed attenuated signal and said input signal (59; MCCS).

Moreover, the invention relates to a phantomizer for processing of a signal into a phantomized signal for reproduction in the center channel of a multi-channel reproduction system, said phantomizer comprising at least one signal input connected to the comb-filtering means, said comb-filtering means feeding at least one signal output.

According to a further preferred embodiment of the invention, the phantomizer comprises one signal input connected to comb-filtering means which again feeds exactly one signal output.

A device according to the invention implies a very simple and cost effective solution, and the device may be applied in any multi-channel system.

The input of the phantomizer is feeding a summing node, said input also feeding the said summing node via a feed forward line, said feed-forward line comprising a delay line serially connected to an attenuator.

According to the above-mentioned embodiment, a very simple and cost-effective implementation of the invention has been obtained.

The delay line has a delay of approximately 0.2 to 0.4 ms, preferably 0.3 ms+/−0.05 ms.

The attenuator attenuates 5 to 20 dB, preferably 9 to 12 dB.

Moreover, the invention relates to an inverse phantomizer for processing of at least two-panned signals into de-phantomized signals for reproduction in a multi-channel rendering system, said phantomizer comprising two signal inputs each connected to inverse comb-filtering means, each inverse comb-filtering means feeding one signal output.

This embodiment makes it possible to use loudspeakers optimized for physical center channel speakers in a traditional stereophonic setup by canceling the sound coloring effect of acoustic comb-filtering inherent in traditional stereos.

Finally it should be noted that a very simple phantomizer according to the invention may be built into consumer multi-channel reproduction systems having a center channel, providing a simple sound-coloring option without adding significant costs to the system. Such a feature may e.g. comprise of both a phantomizer and an inverse phantomizer offering the user simple sound-editing features, i.e. adding phantomized signal components to the center channel, or optionally removing phantomized signal components from phantomized program material during reproduction.

Moreover, the invention relates to a method of phantomizing a center channel signal of a multi-channel reproduction system, said signal being manipulated in such a way that the timbre of the signal, when reproduced in the center channel loudspeaker of a multi channel reproduction system, may be perceived by the listener as a phantomized signal which has been established in a multi-channel reproduction system having no center channel.

A multi-channel reproduction system having no center channel may e.g. be a two-channel stereo loudspeaker system.

A loudspeaker may be understood as one or several loudspeaker transducers arranged in one or several cabinets.

Moreover, the invention relates to a method of phantomizing a center channel signal of a multi-channel reproduction system, said signal being manipulated in such a way that the timbre of the signal, when reproduced in the center channel loudspeaker of a multi channel reproduction system, may be perceived by a listener as an audio-signal reproduced by at least two neighboring channels when established in a multi-channel reproduction system.

Basically, the invention deals with integration of a center channel into a multi channel audio signal including a center channel, in such a way that the listener may perceive the sound image within being disturbed by the center channel.

A center channel signal of a multi-channel reproduction system is phantomized by processing of the center channel approximated to a HRTF based transfer function.

The approximation comprises at least one comb-filtering of the center channel. The approximation comprises a HRTF based head related transfer functions (HRTF; H17L, H18R, H17R H18L, H36L, H36R)) and where the approximation comprises a HL=(H17L+H18R)/H36L and a HR=(H17R+H18L)/H36R filtering of the center channel (59).

For reasons of symmetry, the above signals HL and HR are equal. Hence, they may be established by one filter.

The HRTF based transfer functions may e.g. be established by KEMAR measurements performed by MIT Media Lab.

Basically, the H36R component may typically be approximated to one, or the complete function may be established on the basis of a experience based tuning of filters.

Hence one of several applicable filters within the scope of the invention being approximated to the above stated function may be a comb filter.

Moreover, the invention relates to a phantomizer for processing of sound input signals.

A center channel signal may be understood broadly as a signal intended for reproduction in the center channel loudspeaker of a multi channel reproduction system such as broadcast, webcast, the loudspeaker signal itself or a corresponding signal stored on a medium such as DVD.

FIGURES

The invention will be described below with reference to the drawings where

FIG. 1 shows the traditional stereophonic speaker-setup

Figure 2:
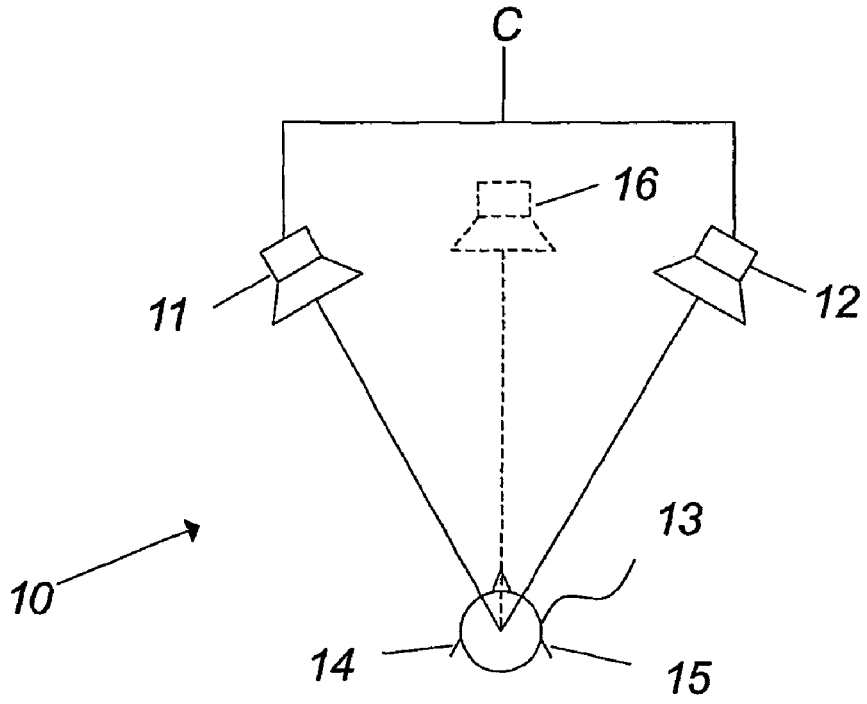
Fig.2 (PRIOR ART)
Figure 3:
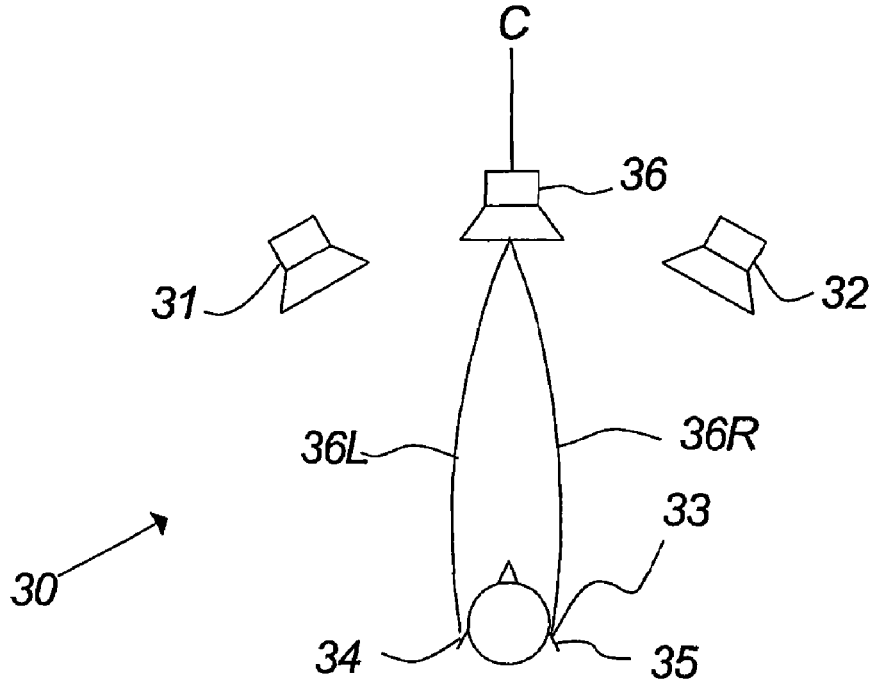
Fig.3 (PRIOR ART)
Figure 4:
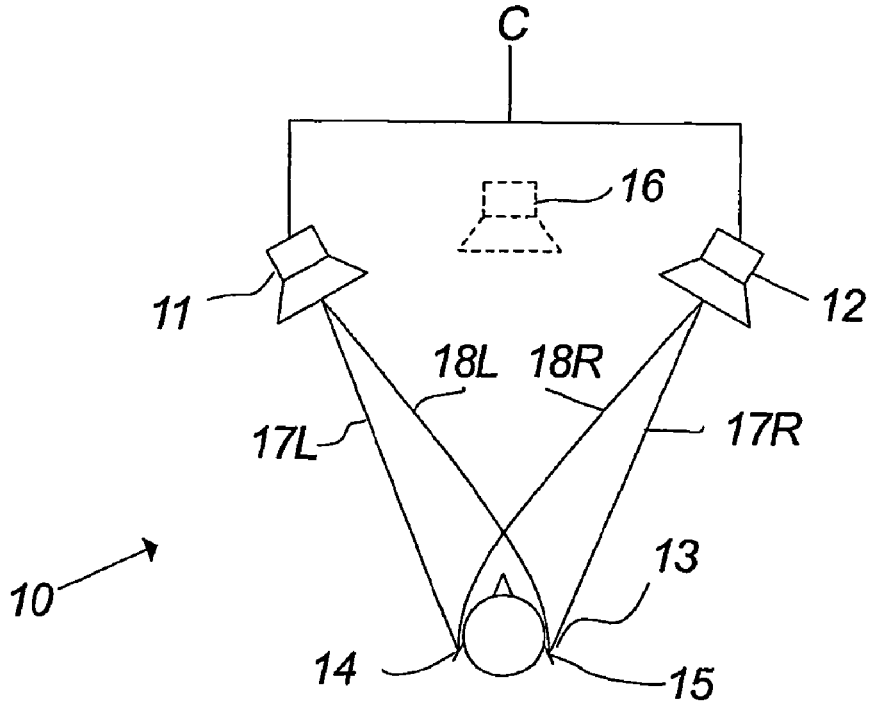
Fig.4 (PRIOR ART)
Figure 5A:
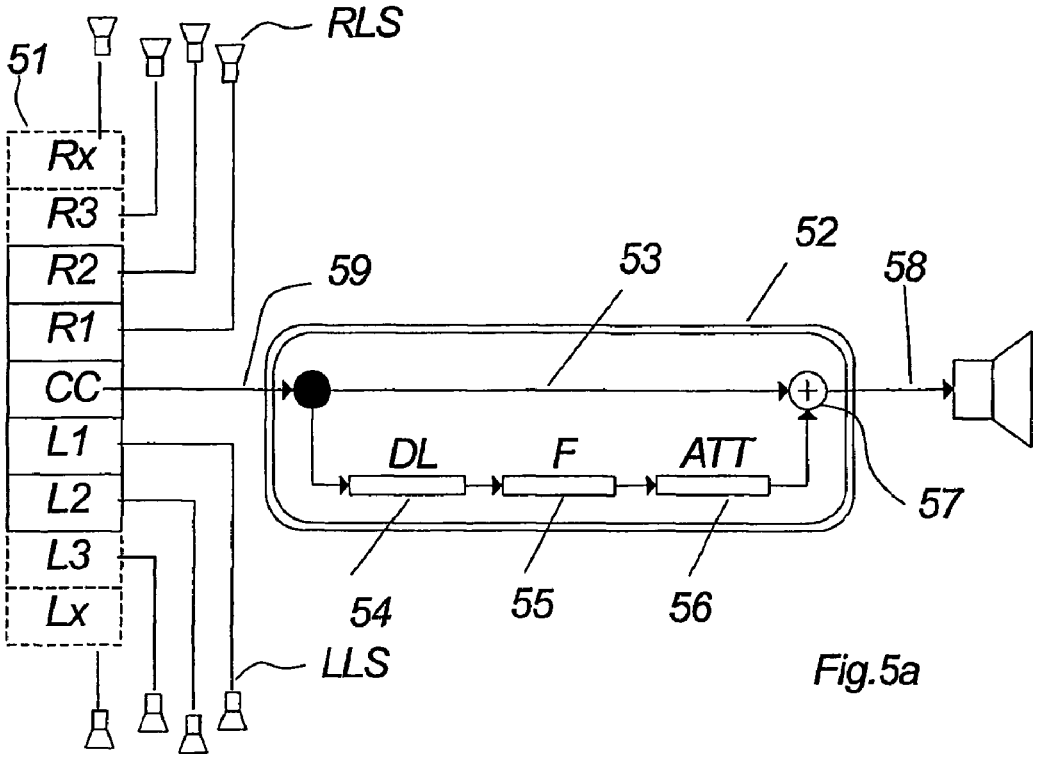
Figure 5B:
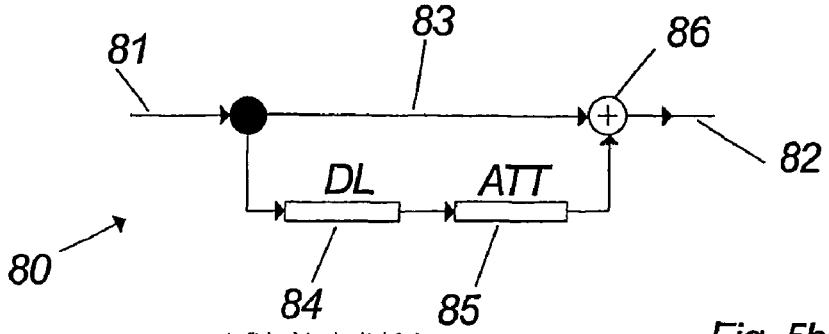
Figure 5C:
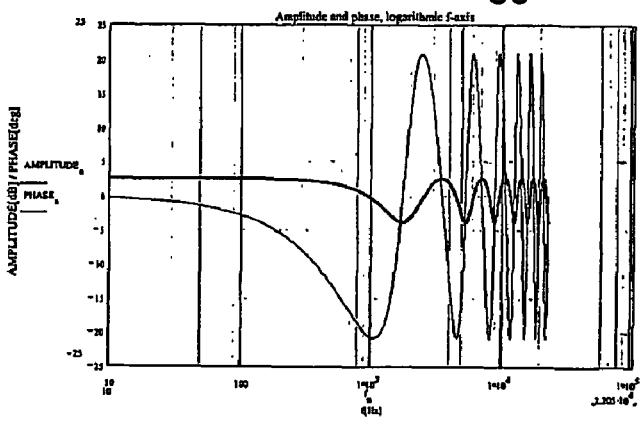
Figure 6:
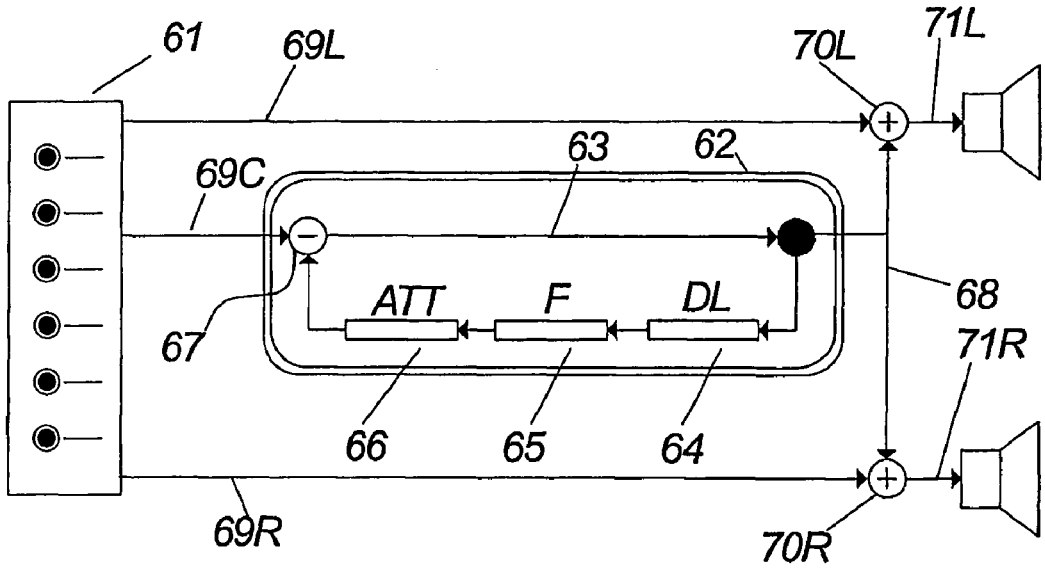
Figure 7:
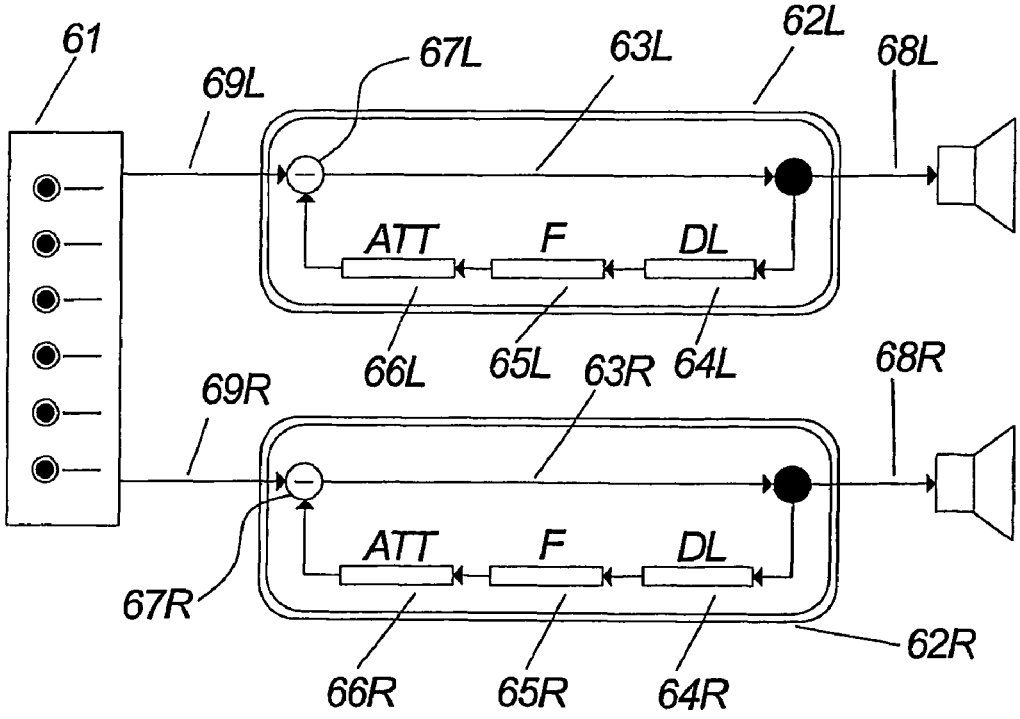

FIG. 2 shows how the traditional speaker-setup emulates a phantom center channel speaker FIG. 3 shows a traditional multi-channel speaker-setup FIG. 4 shows the cause of the comb-filtering effect FIG. 5*a* shows an embodiment of the invention, the Audio Center Channel Phantomizer FIG. 5*b* shows a block diagram of a simple comb-filter FIG. 5*c* shows the frequency response of a simple comb-filter FIG. 6 shows another embodiment of the invention, the Inverse Phantomizer FIG. 7 shows the Inverse Phantomizer applied in a stereo-setup, and where

DETAILED DESCRIPTION

FIG. 1 shows a traditional two-channel stereophonic setup 10 comprising a left channel loudspeaker 11 and a right channel loudspeaker 12. Further, it comprises a listener, a human being 13, having a left ear 14 and a right ear 15.

The listener 13 is located in front of the two loudspeakers 11, 12, facing their center.

When producing music, the different instruments or voices are located in the sound image by feeding the left channel speaker 11 and the right channel speaker 12 with different voltage amplitudes or phases. E.g. if the left speaker 11 plays louder than the right speaker 12, it will seem to the listener 13 that the instruments playing are to the left of his center.

FIG. 2 shows how the traditional stereo system 10 localizes a voice or musical instrument in the center of the sound image. The hardware of the system corresponds to that described in FIG. 1, except for the addition of a phantom center channel loudspeaker 16.

Placing voices or musical instruments right at the center of the stereo image is obtained by simply feeding the source signal to both loudspeakers 11, 12 simultaneously with an identical level and phase. Traditionally, a listener 13 will perceive the place of sound origin to be somewhere between the speakers 11, 12 which is from the phantom center speaker 16.

FIG. 3 shows a multi-channel setup 30 with a left channel loudspeaker 31, a right channel loudspeaker 32 and a physical center channel loudspeaker 36. Additionally, it comprises a listener 33 with a left ear 34 and a right ear 35.

Evidently, according to the invention, the system may comprise further loudspeakers, such as a preferred five channel system comprising one center loudspeaker, two front speakers and two rear speakers.

The listener 33 is placed in front of the center channel speaker 36, facing it.

The multi channel rendering system having a center channel facilitates a relatively simple and accurate localization of a source, when an audio signal has to be located in the center of the sound image established by the system.

Audio signals emitted from the center loudspeaker 36 are basically received as two "separate" signals 36L and 36R by the left and right ear 34, 35 respectively.

Obviously, a sound engineer could simply feed a voice or musical instrument to the center channel loudspeaker 36 in order to locate the signal in the center of the sound image. Such mixing would definitely place the sound source at the center of the sound image and it would also make the obtainable localization less sensitive to variations in the listener's position 33.

However, as the music industry has gained experience with this new reproduction format 30, one problem has become apparent: Many highly esteemed music producers have decided not to use the physical center channel speaker 36, thus discarding its beneficial stabilizing effect on the stereo image. The reason is that even when using 3 identical loudspeakers 31, 32, 36 at the front in compliance with the ITU Recommendation BS.775-1 "Multi-channel Stereophonic Sound Systems with and without Accompanying Picture", the perceived timbre of the physical center channel 36 deviates too much from that of the familiar phantom center channel 16 for which the loudspeakers were optimized in the first place.

The invention deals with this problem.

Again, FIG. 4 shows the traditional stereo system 10, with two physical speakers 11, 12, the phantom center speaker 16 and the listener 13. Additionally, FIG. 3 comprises four paths of sound 17L, 17R, 18L, 18R.

17L illustrates the path of sound from the left loudspeaker 11 to the nearest ear of the listener 13, i.e. the left ear 14. 17R illustrates the path of sound from the right loudspeaker 12 to the nearest ear of the listener 13, i.e. the right ear 15.

18L illustrates the path of sound from the left loudspeaker 11 to the farthest ear of the listener 13, i.e. the right ear 15.

18R illustrates the path of sound from the right loudspeaker 12 to the farthest ear of the listener 13, i.e. the left ear 14.

Sound paths 17L and 17R are the direct paths of sound from speaker to ear, and paths 18L and 18R are moving around the head to the ear farther away.

The problem with the sound engineers not using the physical center channel 36 can now be explained.

The signal reaching each ear from the physical center channel speaker 36 is that of one loudspeaker 36 placed in front of the listener. But the signal reaching each ear from the phantom center channel speaker 16 is the sum of two signals: One following the paths 17L, 18R from the loudspeakers 11 and 12 and one following the paths 18L, 17R from the loudspeakers 11 and 12, respectively.

Thus, the center channel signal of the stereo system 10 fed to each ear is a summation of two different and mutually delayed signals, both of which differ—primarily due to different degrees of shadowing effect of the head 13—from the signal reaching each ear from a physical center channel of the multi-channel system 30.

In a first approximation (the physically correct analysis would include head-related transfer functions, which are fairly complicated, individual, orientation- and position-dependent, as well as the acoustics of the listening room) the difference between the signals reaching the ears from the two types of center channels 16 and 36 can be described as a comb-filtering effect: Adding a delayed and attenuated copy of the sound signal to itself. As a further refinement, a filter may be inserted into the model's delay-and-attenuation signal path in order to approximate the frequency dependence of the above-mentioned shadowing effect.

Thus, because loudspeakers are optimized for phantom center channel 16 reproduction, an undesirable coloration of the physical center channel 36 is perceived, primarily due to the absence of this comb-filter effect.

Using the above introduced terms of FIG. 3 and FIG. 4, when $H_{36L}$ (=36L) represents the transfer function between the center channel loudspeaker 36 and the left 34 ear of a listener located in a certain position relative to the loudspeaker, when $H_{36R}$ (=36R) represents the transfer function between the center channel loudspeaker 36 and the right ear 35 of a listener located in a certain position relative to the loudspeaker, when $H_{17L}$ (=17L) represents the transfer function between the illustrated left speaker 11 and the left ear 14 of a listener 13, when $H_{18L}$ (=18L) represents the transfer function between the illustrated left speaker 11 and the right ear 15 of a listener 13, when $H_{17R}$ (=17R) represents the transfer function between the illustrated right speaker 12 and the right ear 15 of a listener 13, and when $H_{18R}$ (=18R) represents the transfer function between the illustrated right speaker 12 and the left ear 14 of a listener 13, a desired transfer function between a multi-channel rendering system having a center channel and the listener according to the invention may be established as $$HL=(H17L+H18R)/H36L \text{ and}$$

$$HR=(H17R+H18L)/H36R$$

The transfer function is here described with respect to a three channel system for the purpose of explaining the basic features of the invention, and the invention may also be applied in other multi-channel rendering systems, such as five channel systems, etc. Hence, basically the term "left" speaker 31, 11 and "right" speaker 32 refers to all other speakers in the rendering system than the center speaker 36.

According to a simple preferred embodiment of the invention, the center channel may be reproduced according to the properties of only the two illustrated speakers 11, 12 for reasons of simplicity.

It should be noted that the above stated transfer function are equal for reasons of symmetry due to the fact that the invention deals with the center channel. Therefore, both signals may be established by the same filter.

FIG. 5*a* shows a block diagram of a first embodiment of the invention. It comprises a multi-channel audio rendering system 51, e.g. a mixing console, representing audio signals in a 2x+1 channel format, i.e. with x rights channels R1, R2, . . . Rx, x left channels L1, L2, . . . Lx and a center channel CC. According to the illustrated embodiment of the invention the center channel CC is fed to a phantomizer 52 as a center channel output 59. The other channels L . . . , R . . . are fed directly to corresponding loudspeakers LLS and RLS.

The Audio Center Channel Phantomizer 52 is connected to the center channel 59 of the audio rendering system 51, and a center channel loudspeaker 58 is connected to the output of a Audio Center Channel Phantomizer 52.

The Audio Center Channel Phantomizer 52 comprises a direct connection 53 between the input from the center channel 59 of the audio rendering system 51 and the center channel loudspeaker 58 through an algebraic summing point 57.

Further, the Audio Center Channel Phantomizer 52 comprises a delay-line DL 54, a filter F 55 and an attenuator ATT 56.

DL 54, F 55 and ATT 56 form a feed-forward path which is fed from the center channel 59 and ends at the summing point 57.

In order to make the physical center channel 36 useful in music (re-)production without having to re-design the center channel loudspeaker, it is only necessary to add the above-mentioned comb-filtering back into the signal path. Preferably, this should be done at the production stage, so the consumer will not have to change anything. Thus, according to the illustrated embodiment of the invention, the processing circuit comprises a delay line 54 and an attenuator 56—which forms a comb-filter—applied to the center channel output 59 of a multi-channel mixing console or any other means for rendering audio onto any audio media or reproduction setup comprising a physical center channel. This may even include mono. Additional filtering 55 may be added to the delay path. The delay line 54, filter 55 and attenuator 56 may be interchanged arbitrarily with no effect on the function of the invention.

FIG. 5*b* shows a block diagram of an ordinary, simple comb-filter 80. It comprises one input 81 and one output 82. The input 81 and the output 82 are connected by a direct connection 83 through a summing point 86. Further, the comb-filter 80 comprises a feed forward path comprising a delay line DL 84 and an attenuator ATT 85. The DL 84 and ATT 85 are fed from the input 81 and end at the summing point 86.

FIG. 5*c* shows the frequency response of a simple comb-filter 80. This is the effect that the Audio Center Channel Phantomizer 52 contributes to the original center channel signal in its simplest embodiment.

The delay is 0.3 ms and the attenuation has been set to 9 dB.

The comb-filter 80 has two parameters: The delay of the delay line DL 84 and the attenuation of the attenuator ATT 85.

The delay required can be determined simply by considering the physical lengths from each loudspeaker to one ear. This involves only simple trigonometry, i.e. the cosine relations, and the speed of sound. By choosing a certain delay, the distance from the speakers to the listener is also determined.

Determining the attenuation required is a bit harder to do theoretically, and is done by ear in relation to this embodiment.

According to a preferred embodiment of the invention, parameter settings are approximately a delay=0.3 ms and an attenuation=9 dB.

It should be noted that the simple above illustrated preferred embodiment according to the invention is a simple approximation to the above stated transfer functions $$HL=(H17L+H18R)/H36L \text{ and}$$

$$HR=(H17R+H18L)/H36R$$

Several, more complicated approximations to the transfer function may be applied within the scope of the invention.

One of such approximations may be applied when applying the so-called KEMAR HRTF provided by MIT Media Lab as approximation to the HRTF and applying corresponding suitable filters.

FIG. 6 shows a second embodiment of the invention comprising a multi-channel audio rendering system 61, e.g. a mixing console, with a center channel output 69C, a left channel output 69L and a right channel output 69R. Further, it comprises an embodiment of the invention 62, the Inverse Phantomizer with an output 68.

It also comprises two summing points 70L, 70R, and two loudspeakers 71L, 71R.

Again, the Inverse Phantomizer 62 is connected to the center channel 69C of the audio rendering system 61, and the output 68 is connected to the two summing points 70L, 70R. The left channel output 69L of the audio rendering system 61 is added to the output 68 from the Inverse Phantomizer 62 at the left channel summing point 70L, and the left speaker 71L is connected to the output from the left summing point 70L. The right channel output 69R of the audio rendering system 61 is added to the output 68 from the Inverse Phantomizer 62 at the right channel summing point 70R, and the right speaker 71R is connected to the output from the right summing point 70R.

The Inverse Phantomizer 62 comprises a direct connection 63 between the input from the center channel 69C of the audio rendering system 61 and the output 68 through an algebraic subtraction point 67 in this particular embodiment.

Further, the Inverse Phantomizer 62 comprises a delay line DL 64, a filter F 65 and an attenuator ATT 66.

DL 64, F 65 and ATT 66 now form a feed-back-path which is fed from the center channel output 68 and ends at the subtraction point 67.

Contrary to the first embodiment 52, this second embodiment 62 of the invention solves the inverse problem: The use of audio signals adapted for reproduction in physical center channel speakers in a stereophonic setup. In this way, the two speakers 71L, 71R are fed with a modified center channel signal, i.e. inverse-phantomized (also called de-phantomized). Thus, the center channel signal fed to the loudspeakers 71L and 71R are established on the basis of a phantomized center channel signal 69C including the added delay composants providing panning illusions. The signal 69C are fed to the inverse phantomizer 62 in which the added delay composants (and coloring) are removed or decompensated.

Instead of adding an attenuated, delayed and possibly filtered signal to the output as was the case in the first embodiment 52, it is now subtracted at the input 67. As long as the gain through the feedback path 64, 65, 66 is less than unity (which is the case with the above-mentioned typical 9 dB of attenuation), the system is stable and the exact inverse of the first embodiment 52. Hence, it can be used to cancel the effect of the first embodiment 52, if desired.

FIG. 7 shows the second embodiment of the invention, the Inverse Phantomizer 62, used in a stereo setup. It comprises a multi-channel audio rendering system 61, e.g. a stereo mixer with a left channel output 59L and a right channel output 59R. Further, it comprises two Inverse Phantomizers 62L, 62R, a left channel loudspeaker 68L and a right channel loudspeaker 68R, both optimized for use as physical center channel speakers.

It should be noted that the illustrated embodiment may be applied for establishing a virtual center channel in e.g. a stereo system 71L, 71R. Hence, if a "normal" multi-channel signal (i.e. not-phantomized) is fed to the loudspeakers 71L, 71R via an inverse phantomizer 62, the comb-filtering of the center channel may be established as a kind of decompensation of a normal signal, thereby obtaining that the sound is colored in such a way that it may be perceived as a signal which has been "monoficied".

The first Inverse Phantomizer 62L is connected to the left output-channel of the audio rendering system 69L, and the second Inverse Phantomizer 62R is connected to the right output-channel of the audio rendering system 69R. The left channel loudspeaker 68L is connected to the first Inverse Phantomizer 62L, and the right channel loudspeaker 68R is connected to the second Inverse Phantomizer 62R.

This embodiment makes it possible to use audio signals adapted for reproduction in a physical center channel speaker in a traditional stereophonic setup by canceling the sound coloring effect of the acoustic comb-filtering effect, se FIG. 4, and feeding the de-phantomized center channel signals to the two stereo channels.

Overview of cases in which a Phantomizer and Inverse Phantomizer are used:

Two types of setups:

We will divide the reproduction setups into two cases, Phantom Center, where acoustic comb-filtering at the ears of the listener occurs, and Physical Center where no filtering occurs:

$$H_{PhantomSetup} \approx \text{comb}$$

$$H_{PhysicalSetup} \approx 1$$

Two loudspeaker types

We will divide all loudspeakers into two groups: Those designed for mono, which (presumably) have neutral timbre, and those designed for stereo (more common these days), which have been designed with something like an inverse comb-filter response to compensate for the acoustic comb-filtering of the center image in a stereo setup:

$$H_{HTmono} \approx 1$$

$$H_{HTstereo} \approx \text{comb}^{-1}$$

Three Phantomizer usage types

There are three ways to use the Phantomizer: Non-use, use the Phantomizer or use the Inverse Phantomizer:

$$H_{NoPhantomizer} = 1$$

$$H_{Phantomizer} \approx \text{comb}$$

$$H_{Inverse_Phantomizer} \approx \text{comb}^{-1}$$

Combinations yielding neutral timbre

| Setup type | Loudspeaker Type | Phantomizer Type | Result |
|---|---|---|---|
| Phantom | Stereo | None | $\text{comb} \cdot \text{comb}^{-1} \cdot 1 = 1$ |
| Center | Mono | Inverse_Phantomizer | $\text{comb} \cdot 1 \cdot \text{comb}^{-1} = 1$ |
| Physical | Stereo | Phantomizer | $1 \cdot \text{comb}^{-1} \cdot \text{comb} = 1$ |
| Center | Mono | None | $1 \cdot 1 \cdot 1 = 1$ |

The invention claimed is:

1. A method of processing a center input signal of a multi-channel input including said center input signal as a distinct center input, into a phantomized signal comprising:

adding at least one attenuated delayed signal to the center input signal by circuitry to create the phantomized signal, wherein the phantomized signal is fed to a center channel of a multi-channel audio reproducing system and wherein the phantomized signal is perceived by a listener as an audio signal which has been established in a multi-channel reproduction system having no center channel and where the multi-channel reproduction system has two or more channels.

2. The method of processing an input signal according to claim 1 further comprising comb-filtering of the input signal.

3. The method of processing an input signal according to claim 1, wherein the at least one delayed attenuated signal is delayed 0.2-0.4 ms with respect to the signal added to the at least one delayed attenuated signal.

4. The method of processing an input signal according to claim 1, wherein the at least one delayed attenuated signal is attenuated 5 to 20 dB with respect to the signal added to the said at least one delayed attenuated signal.

5. The method of processing an input signal according to claim 1, wherein said phantomized signal comprises said at least one delayed attenuated signal and said input signal.

6. A phantomizer for processing a signal into a phantomized signal comprising:

a center channel of a multi-channel rendering system at which the phantomized signal is reproduced, and at least one signal input connected to comb-filtering means, said comb-filtering means feeding at least one signal output;

such that a timbre of the signal, when reproduced in a center channel loudspeaker of the multi-channel rendering system, is perceived by a listener as an audio signal which has been established in a multi-channel rendering system having no center channel.

7. The phantomizer for processing according to claim 6, wherein said input of the phantomizer feeds a summing node, via a feed forward line, said feed-forward line comprises a delay line serially connected to an attenuator.

8. The phantomizer for processing according to claim 7, wherein said delay line has a delay of approximately 0.2 to 0.4 ms.

9. The phantomizer for processing according to claim 7, wherein the attenuator attenuates 5 to 20 dB.

10. A method of phantomizing a center channel signal of a multi-channel reproduction system, comprising:

manipulating the center channel signal by adding at least one attenuated delayed signal by circuitry to the center channel signal such that a timbre of the signal, when reproduced in a center channel loudspeaker of the multi channel reproduction system, is perceived by a listener as an audio signal which has been established in a multi-channel reproduction system having no center channel.

11. The method of phantomizing a center channel signal of a multi-channel reproduction system according to claim 10, said manipulating of the center channel being approximated to an HRTF based transfer function.

12. The method of phantomizing a center channel signal of a multi-channel reproduction system according to claim 11, wherein said approximation comprises at least one comb-filtering of the center channel.

* * * * *